United States Patent [19]

Parsons

[11] 4,109,422

[45] Aug. 29, 1978

[54] SANDER CLEANING PROCESS

[75] Inventor: James W. Parsons, Ashland, Oreg.

[73] Assignee: Parsons Enterprises, Inc., Ashland, Oreg.

[21] Appl. No.: 838,400

[22] Filed: Sep. 30, 1977

Related U.S. Application Data

[60] Continuation of Ser. No. 673,538, Apr. 5, 1976, abandoned, which is a continuation of Ser. No. 550,151, Feb. 18, 1975, abandoned, which is a continuation of Ser. No. 410,348, Oct. 29, 1973, abandoned, which is a division of Ser. No. 262,621, Jun. 14, 1972, Pat. No. 3,812,622.

[51] Int. Cl.[2] ..... B24B 1/00; B24B 21/18

[52] U.S. Cl. ..... 51/325

[58] Field of Search ..... 51/5 R, 5 D, 5 A, 135 R, 51/262 A, 266, 281 R, 325

[56] References Cited

U.S. PATENT DOCUMENTS

| | | | |
|---|---|---|---|
| 1,413,060 | 4/1922 | Roberts | 51/262 A |
| 1,791,917 | 2/1931 | Winsor | 51/135 R X |
| 2,568,096 | 9/1951 | Stewart | 51/281 R X |
| 2,680,938 | 6/1954 | Peterson | 51/5 A |
| 2,934,279 | 4/1960 | Nestor | 51/135 R |
| 3,167,893 | 2/1965 | Giardini | 51/262 A |
| 3,177,627 | 4/1965 | Guibert | 51/262 A |
| 3,568,377 | 3/1971 | Blohm | 51/262 A |
| 3,596,413 | 8/1971 | Stewart | 51/262 A |

*Primary Examiner*—Donald G. Kelly

*Attorney, Agent, or Firm*—Klarquist, Sparkman, Campbell, Leigh, Hall & Whinston

[57] ABSTRACT

A solvent is sprayed onto a moving sander belt by a solvent nozzle moved across the belt in advance of an air nozzle, which blows air onto the belt. The nozzles are directed toward the belt at an angle such that the air from the air nozzle is deflected toward an exhaust port in a sander housing surrounding the belt. The nozzles form a part of a cleaner mounted as a unit on the sander housing, and including a nozzle carriage reciprocating the nozzles across the belt.

4 Claims, 4 Drawing Figures

TIMER
AIR
SOLVENT
AIR
AIR

SOLVENT
AIR

SANDER CLEANING PROCESS

This is a continuation of application Ser. No. 673,538, filed Apr. 5, 1976 (abandoned), which is a continuation of application Ser. No. 550,151, filed Feb. 18, 1975 (abandoned) which, in turn, is a continuation of application Ser. No. 410,348, filed Oct. 29, 1973 (abandoned), which is a division of application Ser. No. 262,621, filed June 14, 1972, and now U.S. Pat. No. 3,812,622, issued May 28, 1974.

DESCRIPTION

This invention relates to a sander cleaner, and more particularly to a cleaner adapted to clean sanding belts and drums.

An object of the invention is to provide a sander cleaner.

Another object of the invention is to provide a cleaner adapted to clean sanding belts and drums.

A further object of the invention is to provide a sander cleaner which sprays a solvent and drying air sequentially on a sanding element.

Another object of the invention is to provide a cleaner which is easily attached to a sander.

Figure 1:
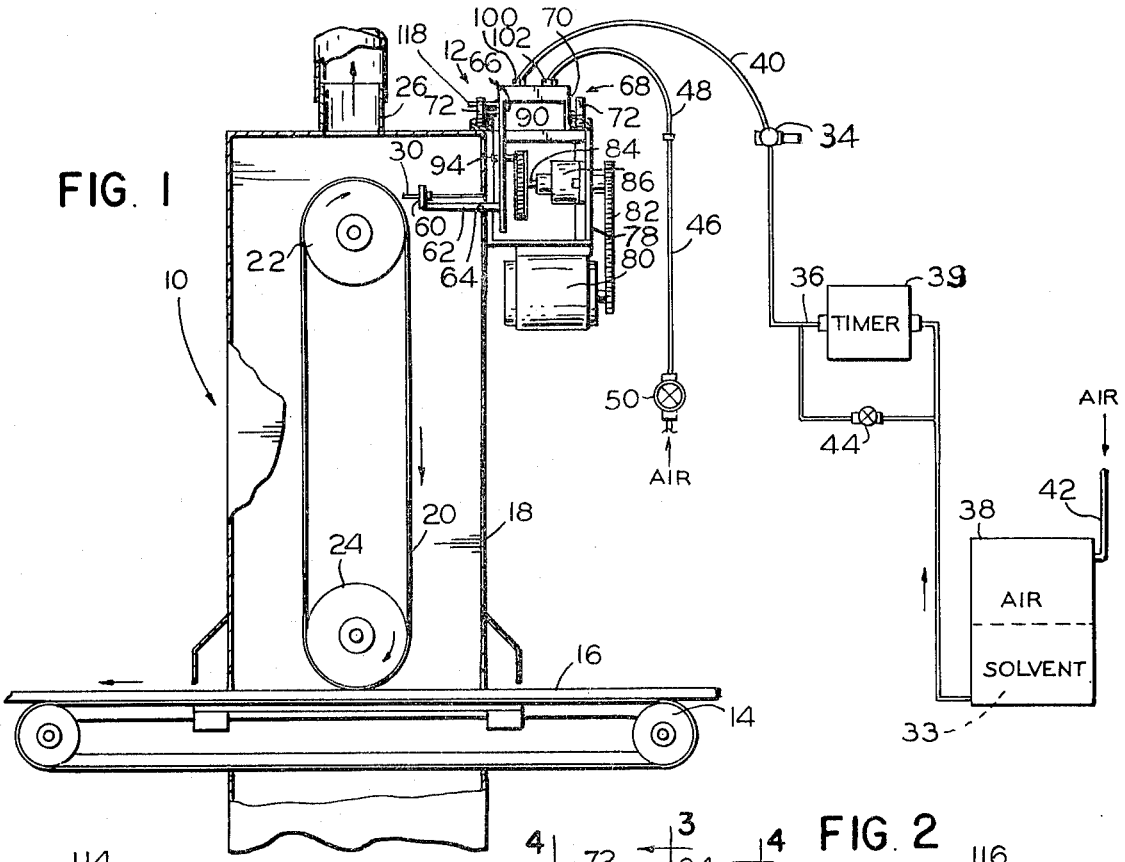
FIG. 1 is a fragmentary, vertical, sectional view of a sander and a sander belt cleaner forming one embodiment of the invention.

Referring now in detail to the drawings, there is shown therein a sander 10 and a sander belt cleaner 12 forming one specific embodiment of the invention. The sander includes a conveyor 14 advancing a plywood sheet 16 through an exhaust housing 18 and under a sanding belt 20, which is entrained over rolls 22 and 24 and is advanced thereby. Air is flowed upwardly through the housing, and is exhausted, along with sawdust and cleaning fluid through an exhaust port 26.

Figure 2:
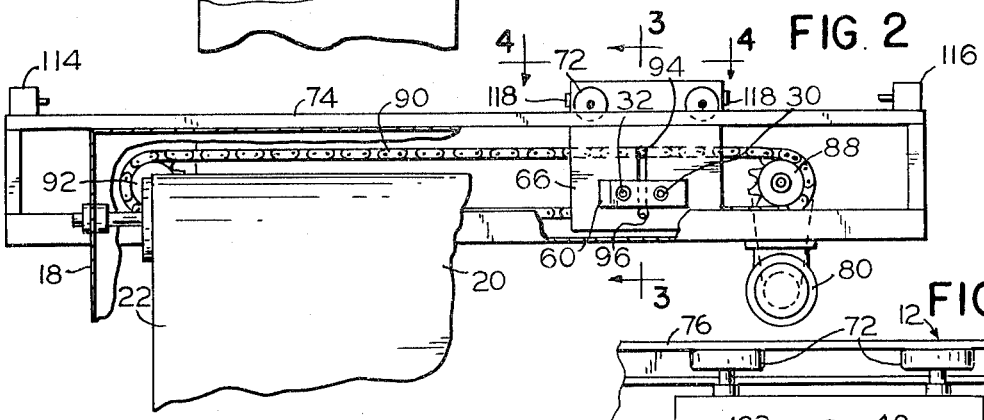
FIG. 2 is an enlarged, fragmentary, partially, sectional, elevation view of the sander and sander belt cleaner of FIG. 1.

To clean the gritted surface of the sanding belt 20, the cleaner 12 includes an air nozzle 30 and a solvent nozzle 32 continuously reciprocated across the portion of the belt being advanced around the roll 22, and a liquid solvent 33 is sprayed by the nozzle 32 during movement of the nozzle 32 only in its stroke from right to left, as viewed in FIG. 2, and not in the other direction, while air under pressure is directed continuously by the nozzle 30 during both directions of movement of the nozzle. A solenoid operated valve 34 in a line 36 from a pressurized solvent tank 38 to a hose 40 connected to the nozzle 32 keeps the line 36 open to flow to the nozzle 32 during movement of the nozzle to the left, as viewed in FIG. 2, and prevents flow through the line 36 to the nozzle 32 during movement of the nozzle to the right. A line 42 (FIG. 1) from a source of air under pressure supplies compressed air to the tank 38, and a timer valve 39 in the line 36 is open periodically for a predetermined cleaning period of time and is closed for a second predetermined period of time between cleaning periods. A manually operated valve 44 paralleling the timer valve 39 normally is closed, but may be opened to continuously supply solvent to the nozzle 32. A line 46 with air under pressure supplied air under pressure continuously to a hose 48 connected to the nozzle 30. The line 46 has a manual valve 50 for adjusting flow and for shutting off the air to the nozzle 30 when desired.

The nozzles 30 and 32 are mounted on an upstanding flange 60 of a mounting plate 62 projecting through a slot 64 in the housing 18 and mounted on a hanger plate 66 forming a part of a carriage 68 having a body 70 carried by rollers 72 movable along channel-like tracks 74 and 76 fixed to the top of a cleaner housing or frame 78. The housing 78 is attached to the sander housing 18 by bolts so that the cleaner may be installed in and detached from the sander housing as a unit.

The carriage 68 is driven by a variable speed electric motor 80 (FIG. 1) mounted on the bottom of the cleaner housing 78, a chain-and-sprocket drive 82, a shaft 84 journaled in a cantilever-type bearing 86, a sprocket 88 (FIG. 2), a chain 90 coursing on the sprocket 88 and a sprocket 92, a pin 94 carried by the chain 90 and a slot 96 in the hanger plate 66.

Figure 3:
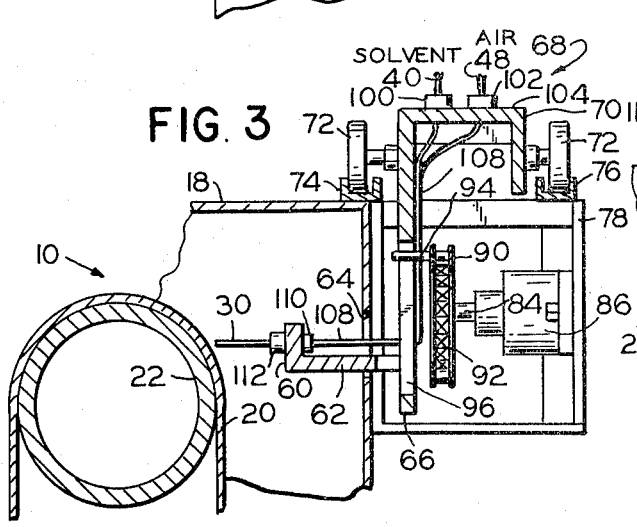
FIG. 3 is an enlarged, vertical, sectional view taken along line 3—3 of FIG. 2; and, FIG. 4 is an enlarged, fragmentary, top plan view taken along line 4—4 of FIG. 3.

The hoses 40 and 48 (FIGS. 1 and 3) are connected to fittings 100 and 102 mounted on top plate 104 of the carriage 68 and connected to the nozzles 32 and 30 by conduits 106 and 108 (FIG. 4) running down and secured by clips to the inside face of the hanger plate 66 and secured by nuts 110 and stops 112 to the flange 60 of the mounting plate 62. Limit switches 114 and 116 are provided for actuation by arms 118 on the carriage to actuate the solenoid operated valve 34, so that solvent is delivered to the nozzle 32 only during reciprocation of the carriage 68 in the direction in which the solvent nozzle precedes the air nozzle 30.

OPERATION

The plywood sheet 16 is advanced through the housing 18, and the sander belt 20 driven at a high speed sands the upper surface of the sheet. Air is flowed up through the housing 18 to remove the sawdust and grit, and the nozzles 30 and 32 are reciprocated back and forth across the sanding belt.

Figure 4:
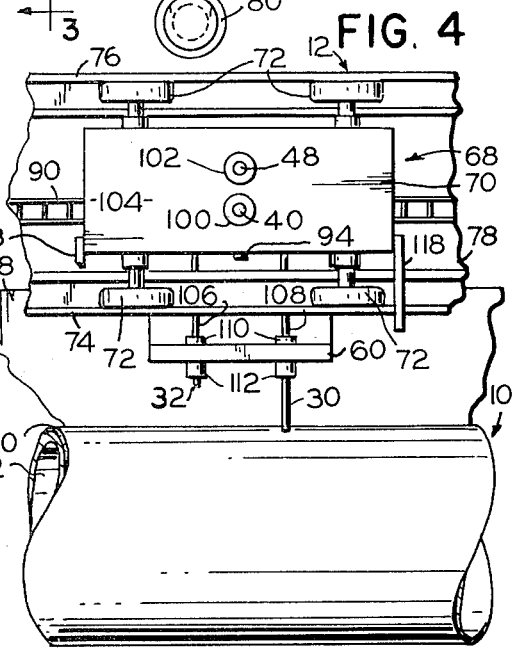

During each stroke of the nozzles to the left, as viewed in FIGS. 2 and 4, the nozzle 32 directs a high velocity jet of the solvent onto the portion of the belt traveling over the roll 22 in advance of the air nozzle 30 which directs a high velocity jet of air onto the freshly wetted portion of the sander to blow the solvent and dissolved gum and loosened debris off the belt and into the air stream flowing to the exhaust port.

In order to make the sanding of such surface more uniform the sanding belt assembly including the rolls 22 and 24 carrying the sanding belt 20 are rapidly reciprocated a short distance axially of the axes of the rollers in commercial plywood sanding machines, and the distance between the nozzles 30 and 32 is preferably somewhat greater than the distance through which the sander belt assembly is reciprocated.

The angle of impingement of the air from the nozzle 30 onto the belt on the roll 22 is such as to deflect the air, solvent and debris upwardly toward the exhaust port 26. Also the particles of grit on the outer surface of the sanding belt are separated from each other as the belt travels around the curved surface of the roll 22 so that the air and solvent directed at an angle to the belt in a reverse direction to that of the travel of the belt effectively lifts such debris from the belt. The air from the nozzle 30 preferably dries the belt substantially completely. This may be regulated by adjustment of the valve 50. The solvent preferably is a low flash point solvent and may be, for example, tetrachloroethylene, although any other suitable low flash point solvent for the gum or pitch or other materials adhering to the belt may be employed. During the return strokes of the nozzles, the air nozzle 30 continues to blow air on the belt while the nozzle 32 is shut off. The motor drives the nozzles at a rate which may, for example, be varied from 2 feet per minute to 12 feet per minute, depending on the belt travel speed. Commercial plywood sanders also usually include another sander belt and rolls similar to the belt 20 and rolls 22 and 24 in an inverted position below the plywood sheet 16 for sanding the lower surface of the sheet. It is apparent that a similar sander cleaner can be employed to clean such sander belt. The cleaner is also very effective for cleaning other types of sanders, as, for example, drum sanders.

What is claimed is:

1. The method of cleaning an elongated, flexible strip having abrasive particles adhered to one face thereof and abrading therewith comprising:

advancing the strip continuously repeatedly in a predetermined direction along a predetermined path having straight portions and a pair of convex portions with the abrasive particles at the outside of the convex portions to alternately straighten and flex the strip so that the particles are alternately closed and spread apart, abrading a workpiece with one of the convex portions of the strip, and spraying a hydrocarbon solvent and air on the other convex portion of the strip travelling over the other convex portion of the path.

2. The method of claim 1 wherein the solvent and air are directed at least partially tangentially at the last mentioned convex portion of the strip and generally in a direction opposite to said predetermined direction.

3. The method of claim 2 including blowing air onto each portion of the strip immediately after the solvent is sprayed onto that portion.

4. The method of abrading with and cleaning an endless abrasive strip having abrasive particles on its outer face while the strip is abrading comprising;

advancing the strip repeatedly over a pair of parallel rollers so that the strip is alternately straightened and flexed, engaging a workpiece to be abraded with the strip at one of the rollers whereby abraded material is picked up by the abrasive particles, and spraying a hydrocarbon solvent and air on the flexed portion of the strip at the other roller.

* * * * *